US007493737B2

(12) United States Patent
Smith

(10) Patent No.: US 7,493,737 B2
(45) Date of Patent: Feb. 24, 2009

(54) ROOFING APPARATUS

(75) Inventor: Leonard C. Smith, New Fairfield, CT (US)

(73) Assignee: Jenrose LLC, Danbury, CT (US)

( * ) Notice: Subject to any disclaimer, the term of this patent is extended or adjusted under 35 U.S.C. 154(b) by 644 days.

(21) Appl. No.: 10/740,198

(22) Filed: Dec. 18, 2003

(65) Prior Publication Data

US 2004/0128945 A1 Jul. 8, 2004

Related U.S. Application Data

(60) Provisional application No. 60/434,111, filed on Dec. 18, 2002.

(51) Int. Cl.
*E04D 15/00* (2006.01)
*E04F 21/00* (2006.01)
*E04G 21/14* (2006.01)

(52) U.S. Cl. ..... 52/749.12; 52/746.11; 182/45

(58) Field of Classification Search ..... 52/749.1, 52/749.12, 127.5, 746.11; 182/45, 106
See application file for complete search history.

(56) References Cited

U.S. PATENT DOCUMENTS

| | | | | | |
|---|---|---|---|---|---|
| 677,645 | A * | 7/1901 | Elkins | 182/37 |
| 2,814,533 | A * | 11/1957 | Van Horn | 182/14 |
| 3,245,192 | A * | 4/1966 | Hilson | 52/746.11 |
| 4,785,606 | A * | 11/1988 | Burton | 52/749.12 |
| 5,081,815 | A * | 1/1992 | Carnell | 52/749.12 |
| 5,205,103 | A * | 4/1993 | Burton | 52/749.12 |
| 5,381,597 | A * | 1/1995 | Petrove | 29/714 |
| 5,937,972 | A * | 8/1999 | Andre | 187/210 |
| 6,470,646 | B1 * | 10/2002 | Bryant | 52/749.12 |

* cited by examiner

*Primary Examiner*—Richard E. Chilcot, Jr.
*Assistant Examiner*—Chi Q Nguyen
(74) *Attorney, Agent, or Firm*—Perman & Green, LLP

(57) ABSTRACT

A pitched roof roofing apparatus. The roofing apparatus has a support rail and a platform movably mounted to the support rail. A drive system operably connects the platform to the support rail. The drive system moves the platform on a pitched surface in at least two orthogonal directions relative to the support rail.

21 Claims, 8 Drawing Sheets

ROOFING APPARATUS

CROSS REFERENCE TO RELATED APPLICATIONS

This application claims the benefit of U.S. Provisional Application No. 60/434,111 filed Dec. 18, 2002 which is incorporated by reference herein in its entirety.

BACKGROUND OF THE INVENTION

1. Field of the Invention

The present invention relates to a roofing apparatus and, more particularly, to a roofing apparatus for pitched roofs.

2. Brief Description of Earlier Developments

The removal and installation of roofing materials, such as shingles or other roofing materials presents both logistical and labor intensive difficulties. These difficulties are due to factors such as weight and size of the roofing materials and the location and slope of the roof. These factors make it difficult to remove, deliver and install roofing materials. Earlier methods have relied on ladders with labor to deliver material, nailing shelves to the roof for roofer and material support, and using equipment such as fork lifts for material delivery. These approaches suffer from difficulties such as not being able to easily move the shelves without damage to the sloped surface and the attendant danger to the roofers, or such as a high labor content. Accordingly, there is a need for an apparatus to support and deliver roofers or roofing material on and to the sloped surface of a roof that is easily movable with minimum labor about the sloped surface.

SUMMARY OF THE EMBODIMENTS

In accordance with a first embodiment, a pitched roof roofing apparatus is provided. The roofing apparatus comprises a support rail and a platform movably mounted to the support rail. A drive system operably connects the platform to the support rail. The drive system is adapted to move the platform on a pitched surface in at least two orthogonal directions relative to the support rail.

In accordance with another embodiment, a pitched roof roofing apparatus is provided. The roofing apparatus comprises a support rail and a platform movably coupled to the support rail. A drive system operably connects the platform to the support rail by at least two cables. A lowering platform is coupled to the drive system. The drive system is adapted to move the platform on a pitched surface in at least two orthogonal directions relative to the support rail. The drive system is further adapted to move the lowering platform in one direction relative to the drive system.

In accordance with another embodiment, a pitched roof roofing apparatus is provided. The roofing apparatus comprises a support rail and a platform movably mounted to the support rail. A drive system operably connects the platform to the support rail. The drive system has a horizontal drive unit to move the platform on a pitched surface in a first direction. The drive system has a vertical drive unit to move the platform on a pitched surface in a second direction orthogonal relative to the first direction.

BRIEF DESCRIPTION OF THE DRAWINGS

The foregoing aspects and other features of the present invention are explained in the following description, taken in connection with the accompanying drawings, wherein.

DETAILED DESCRIPTION OF THE EXEMPLARY EMBODIMENT

Figure 1:
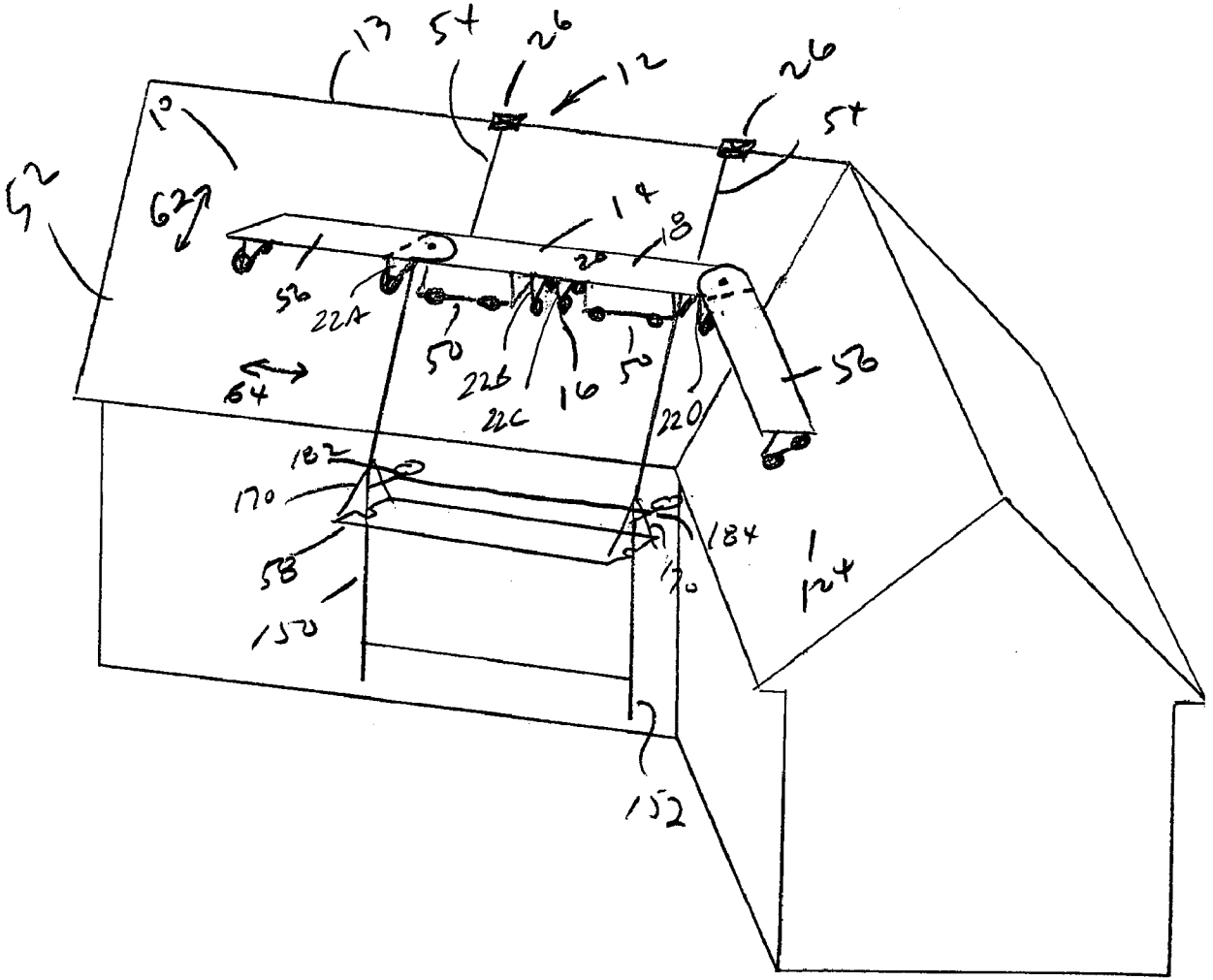
FIG. 1 is a perspective view of the roofing apparatus incorporating features in accordance with an exemplary embodiment of the present invention.

Referring to FIG. 1, there is shown a perspective view of a main platform of a roofing apparatus 10 incorporating features in accordance with an exemplary embodiment of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The roof tractor apparatus 10, as will be described in greater detail below, removes the logistical and labor intensive hardship out of roofing. The roof tractor has a platform of desired size that will take an operator or roofer to any part of the roof on a sloped surface. The roof tractor moves vertically and horizontally with the push of a switch.

Figure 2:
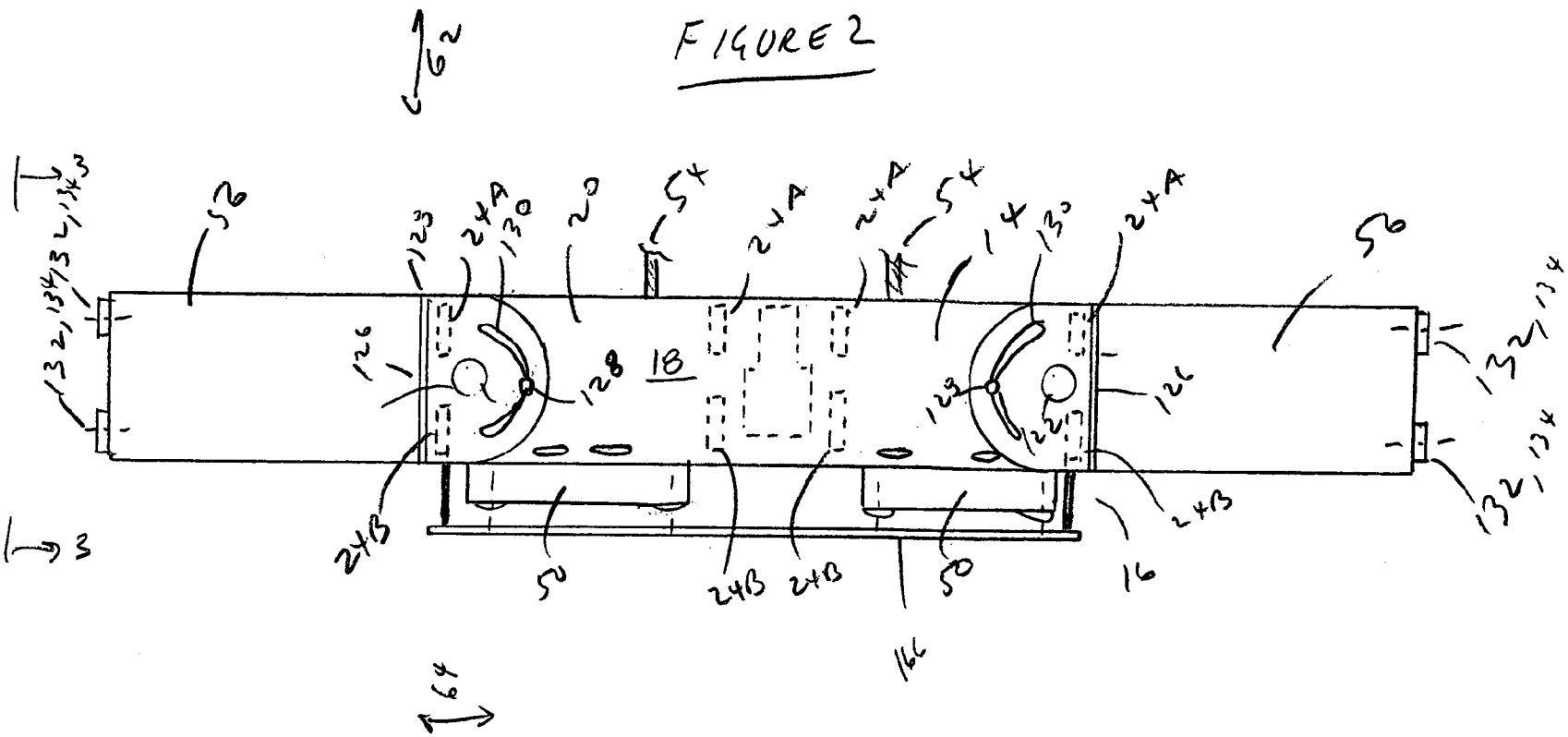
FIG. 2 is a top plan view of the main platform of the roofing apparatus in FIG. 1.
Figure 3:
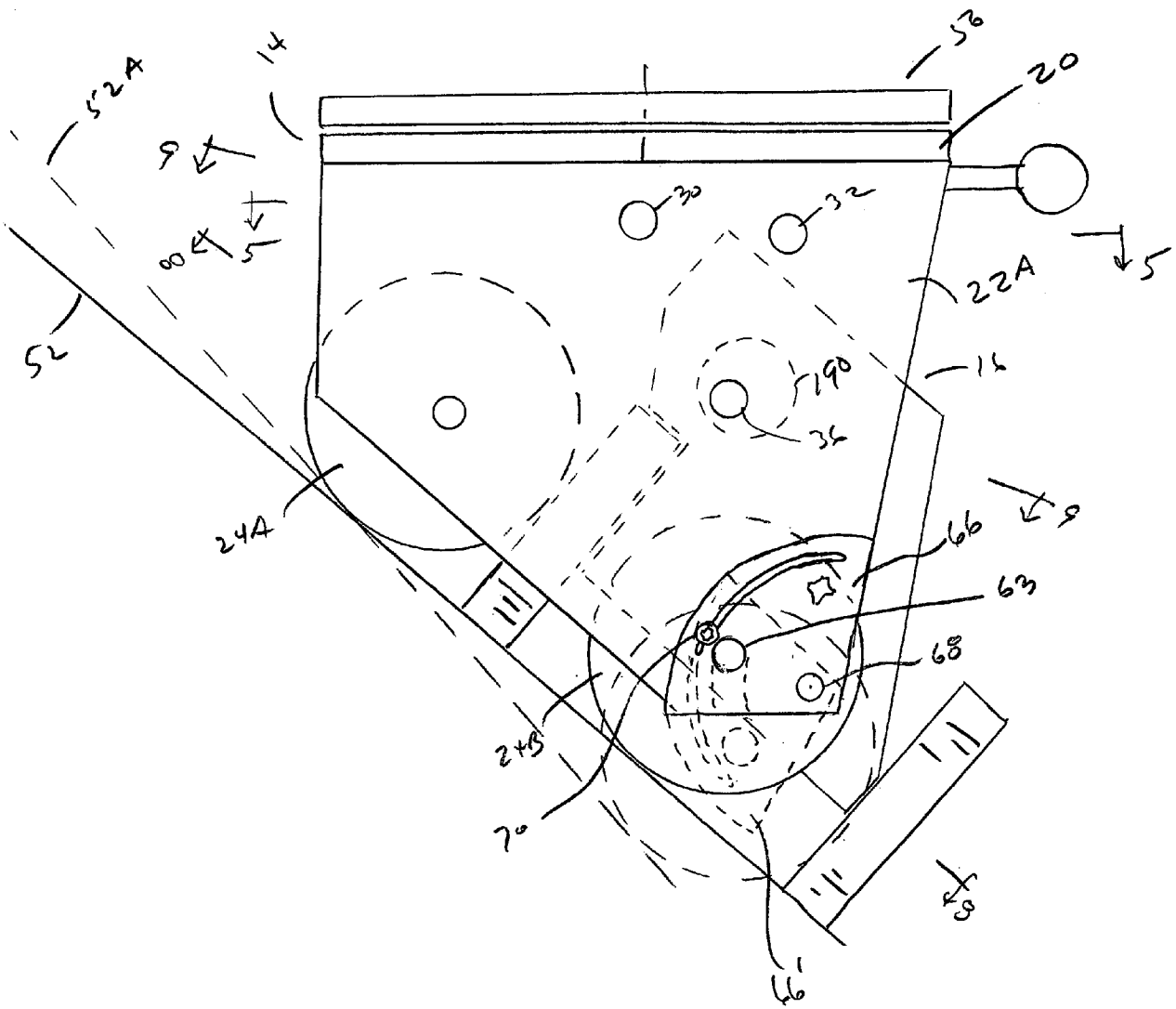
FIG. 3 is a side elevation view of a drive system and platform of the roofing apparatus in FIG. 1.

The roofing apparatus 10 or roofing tractor 10 generally comprises a support system 12, platform system 14, and a drive system 16. The support system 12 is configured to support the platform system 14 and drive system 16 on a pitched surface of a roof 52. A lowering platform 58 for materials or to support roofers may also as provided. Lowering platform 58 may be used to move roofing materials from ground level up to the platform system 14 or to support roofers, as for example when the lower portion of surface 52 is being covered with roofing materials, such as shingles for example. The platform system is attached or mounted to the support system 12 to allow the platform system to move freely both vertically (as indicated by arrow) 62 and horizontally (as indicated by arrow) 64 as desired over the pitched surfaces. The drive system 16 connects the platform system 14 to the support system 12 to power movement of the platform system in both vertical 62 and horizontal 63 directions. Cables 54 couple a vertical drive section of drive system 16 to support system 12. Cables 170 couple drive system 16 to lowering platform 58. Guide bars 150, 152 guide and stabilize lowering platform 58 as it is being raised and lowered. Guide bars 150, 152 and lowering platform 58 may move horizontally 64 with the horizontal drive section of drive system 16 as desired depending on the area of surface 52 the roofer desires to access. When lowering platform 58 is not in use, it may be stowed along with guides 150, 152 at the rear of the drive system 16. The platform system 14 has a main platform 18 that provides mounting features for attaching the platform system to the support system 12. The main platform also interfaces with the pitched roof surface 52, and mounts the drive system 16. As seen in FIGS. 1-3, the main platform 18 has upper platform section or deck 20, and support plates 22A-22D. The support plates are provided with rollers 24A, 24B oriented to allow the platform to roll back and forth in the vertical 62 (i.e. pitched) direction. Referring to FIG. 3, (showing an elevation of one of the support plates 22A) rollers 24B are adjustable in height relative to the upper platform section 20 to allow the platform system to be placed on surfaces with different pitch angles, such as pitched surface 52A, while having the upper platform section 20 remain aligned substantially horizontally. To allow this feature, plate 66 is provided and may be pivotal about pin 68 upon loosening screw 70 in order to position roller 24B into an alternative position, such as position 24B', thus enabling platform section 20 to remain parallel to the ground (substantially horizontal) when used with an alternate surface pitch, such as surface 52A. Plate(s) similar to plate 66 may similarly be employed on supports 22A-22D as desired to enable uniform adjustment.

Figures 5, 6, 7:
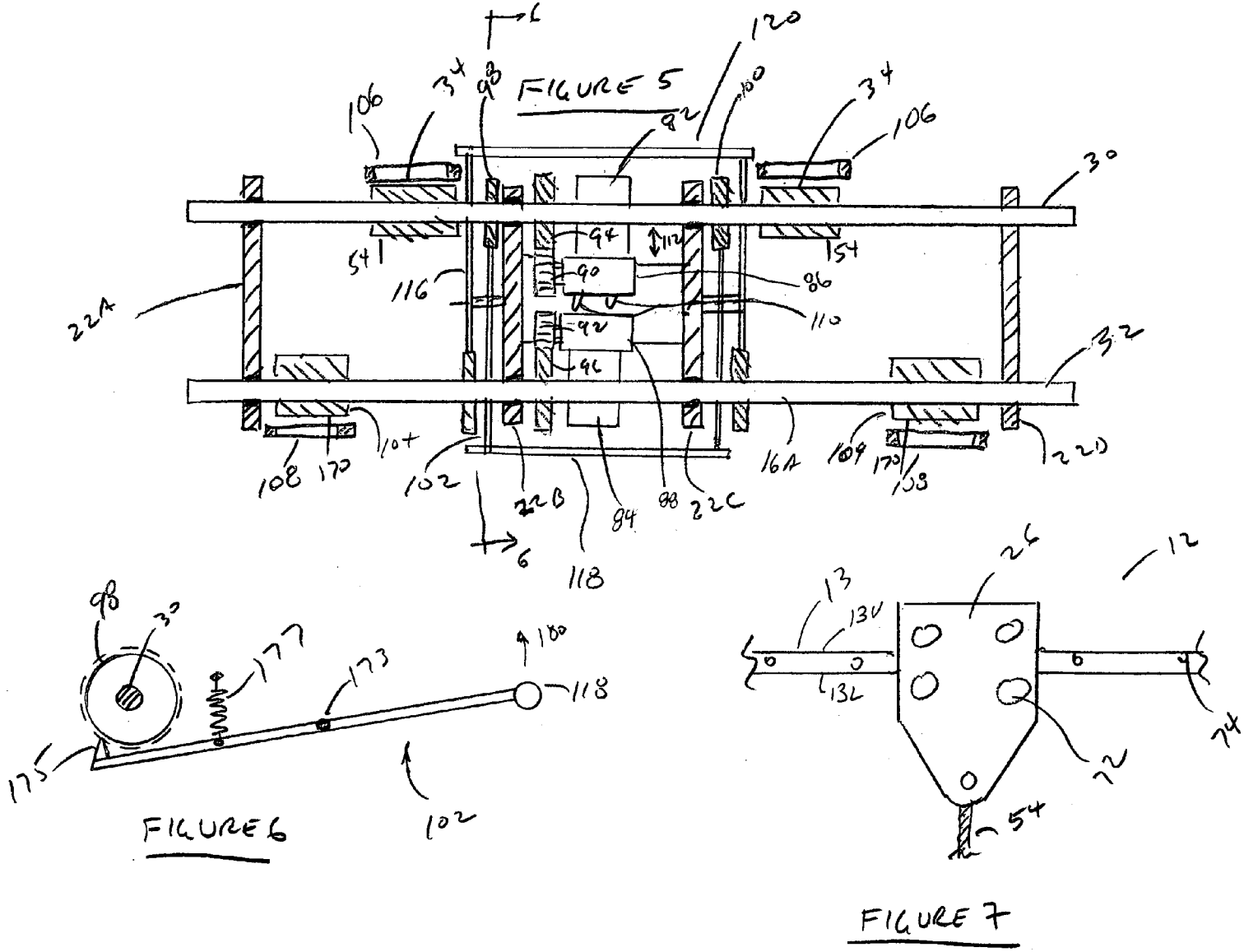
FIG. 5 is a top section view of a drive system of the roofing apparatus in FIG. 1.
FIG. 6 is a side elevation view of a locking mechanism of the roofing apparatus in FIG. 1.
FIG. 7 is a top plan view of support plates of a support system of the roofing apparatus in FIG. 1.

Referring also to FIG. 7 (which shows a partial elevation view of the support system 12), the support system 12 may include top rail 13, and rail slides 26 (for example two rail slides may be used as shown in FIG. 1). The rail slides 26 may have rollers 72 (four are shown for example) allowing the rail slides to slide freely along the top rail 13. The rail 13 may be formed from any suitable structural section (such as for example square tubing) forming rolling surfaces for rollers 72 of slides 26. In the embodiment shown in FIG. 7, the rail 13 has upper and lower rolling surfaces 13U, 13L. Rollers 72 ride on the upper and lower surfaces 13A, 13B thereby stably holding the slide on the rail. The rail 13 may have suitable mounts 74 that may be used to fix the rail to the roof structure. The rail 13 may be formed segmented as desired to form a rail of any desired length. The mounts 74 are positioned on the rail to allow slides 26 to move along the rail past the mounts without interference. The mounts 74 suspend the rail at a stand off from the roof structure so that the slides 26 may move freely along the rail 13 without interference from roof structure. The main platform of the platform system may be mounted by cables 54 to the rail slides 26. The support cables 54 may be connected at one end to the rail slides 26 as shown in FIG. 7. The cables 54 are connected to winches, on shafts mounted to the main platform, driven by the drive system 16 as will be described further below.

Figure 8:
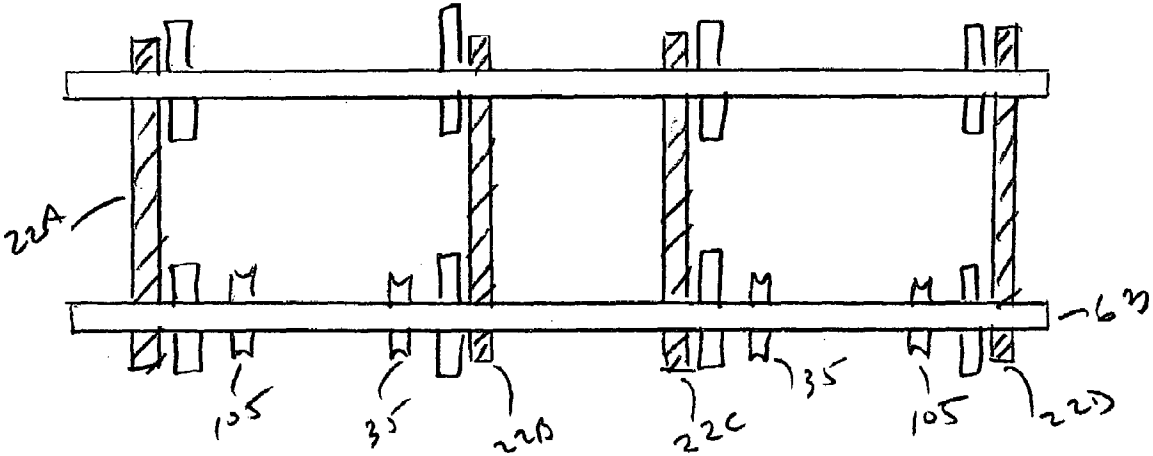
FIG. 8 is another top section view of the drive system of the roofing apparatus in FIG. 1.
Figure 11:
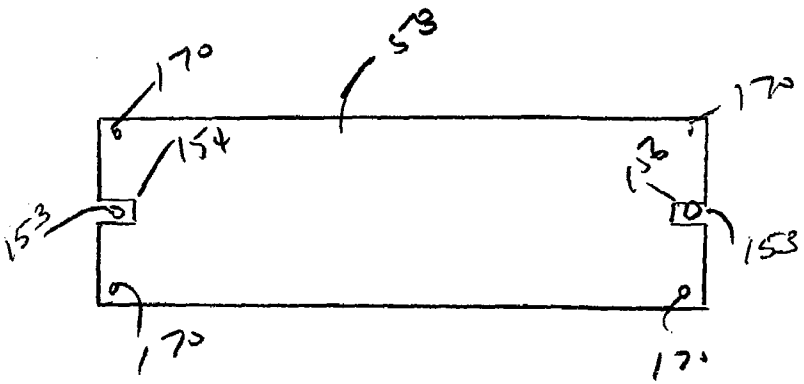
FIG. 11 is a top elevation view of a lowering platform of the roofing apparatus in FIG. 1.
Figure 10:
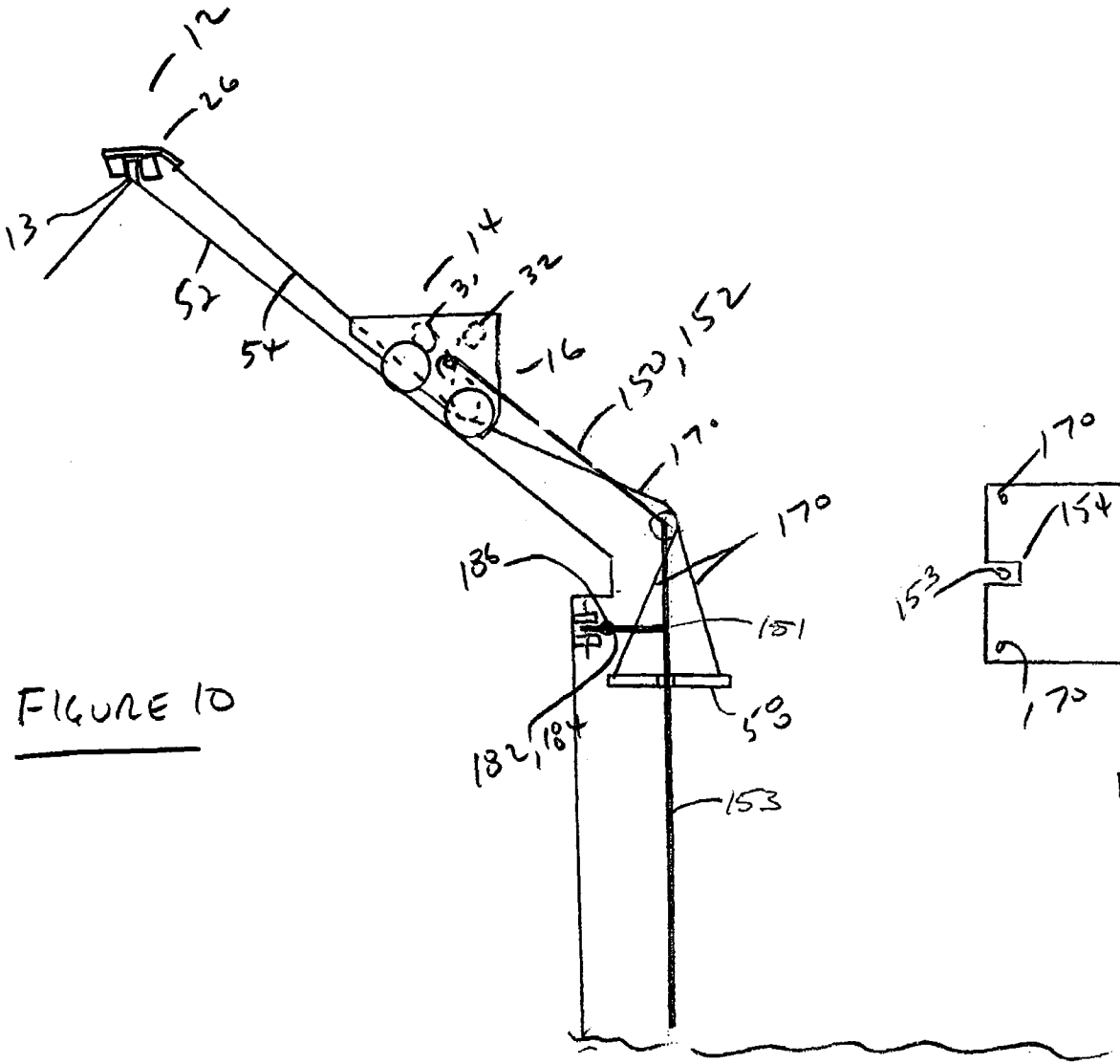
FIG. 10 is a side elevation view of the roofing apparatus in FIG. 1.

Referring now to FIG. 5, showing a sectional view taken along line 5-5 in FIG. 3, the vertical drive section 16A of drive system 16 may have, for example 2 motors, for example, electric 110 v 220½ hp motors 82, 84. They may be coupled to a gear reduction box 86, 88 that may have an input of 1750 rpms and an output of 29 rpms for example. Attached to the output shaft may be gears, such as 2" multi tooth gear 90, 92 and matched to gears such as 5" gear 94, 96 to reduce the rpms to 9⅓ rpms. Gears 94, 96 are coupled to shafts 30, 32 respectively. The high gear reduction allows the operator to move at a slow speed and can provide locking upon power down. One drive motor may drive shaft 30 and the other may drive shaft 32. Referring also to FIGS. 8, 10 and 11, shaft 30 may have two winch drums 34 around which the respective cables 54 connecting the main platform to the rail are wound. Cable 54 may be routed from drum 34, through guide 106, around pulley 35 of shaft 63 and up to slide or carrier 26 of support 12. As can be realized, the motor may be operated to unwind the cable of the drum, thereby lowering the platform over the pitched surface, and may also be operated in the opposite direction to wind the cable and raise the platform. Shaft 30 may be provided with a desired number of dogged wheels 98, 100 which engage a spring loaded latch 102 to prevent inadvertent unwinding of the cable. Similarly, shaft 32 may also have a desired number of dogged wheels which engage a spring loaded latch to prevent inadvertent unwinding of the cable 170. Another motor may drive shaft 32 which maybe used to raise/lower the lowering platform relative to the main platform or drive system. In alternate embodiments, shaft 32 may be used, for example, to raise and lower the horizontal unit(s) 50 (see FIG. 1). Shaft 32 may have two winch drums 104 around which the respective cables 170 connecting the lowering platform 58 to the drive system are wound. Cable 170 may be routed from drum 104, through guide 108, around pulley 105 of shaft 63 and down to lowering platform 58. As can be realized, the motor may be operated to unwind the cable of the drum, thereby lowering the lowering platform, and may also be operated in the opposite direction to wind the cable and raise the lowering platform. The drive system may have four drum cables 34, 104 each holding for example about 120' of cable 54, 170. Mounted directly in front of them may be a mechanical cable guide 106, 108. This guide may ensure correct cable wind up on each drum. A restrainer (not shown) may be mounted on the backside of the cable guide to eliminate any slack in the cable.

In an alternate embodiment, both shafts 30, 32 of the vertical drive section 16A may be used to raise and lower the main platform. In this case, the cables from all of the four drums are connected to the rail slides 26 in a manner, such as previously described. In this case, one motor 82 may be used to power both the drive shafts such as where the motor is unidirectional. The apparatus vertical drive unit 16A may have a 1½" slotted holes 110 that can allow the motor 82 to be shifted from drive shaft 30 to drive shaft 32 (in this embodiment, motor 84 would not be provided). Drive shaft 30 can advance the apparatus upwards, while drive shaft 32 can move the apparatus in reverse. As can be seen, drive shafts 30, 32 may be used in any of a number of combinations. The rollers 24A, 24B (see FIG. 3) may comprise a two wheel unit, each with a 5½" diameter for example between ¼" walls. These rollers may be sheaves (not shown) or have sheaves added to provide a mounting interface with support plates 22A-22C. As seen in FIG. 3, the platform system 14 will ride on the rollers 24A-24B ascending/descending to and from the roof (see also FIG. 2). Referring also to FIG. 6, both drive shafts 30, 32 may have a built in double dog system 102, 116 (see also FIG. 3) that may be engaged 100% of the time. In the event they are used, the operator may physically releases either of the drive shaft's double dogs. This can be accomplished if the operator has one hand on the toggle switch to engage one of the motors and the other hand on the dog release 118, 120. Exemplary system 102 has pivot 173 coupled to support 22B. Dog 175 engages sprocket or gear 98 and is locked with spring 177. Release is accomplished when the operator lifts 180 bar 118. A similar system is provided with sprocket 100 and support 22C coupled by bar 118. A similar double dog safety system may be provided with shaft 32 as shown or otherwise on other shafts. The motor, such as the two 110-220V motors 82, 84 may run off a 2 pole double throw switch (not shown).

Figure 14:
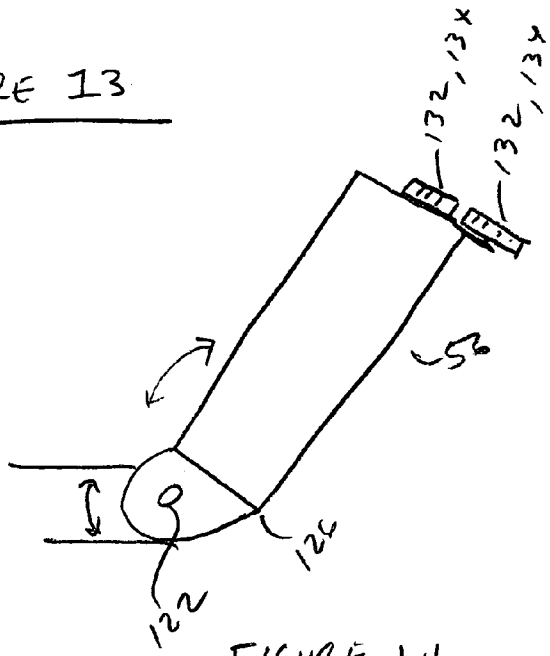
FIG. 14 is a partial perspective view of a movable wing platform of the roofing apparatus in FIG. 1.

Referring also to FIGS. 1, 2 and 14, the main platform 18 of the apparatus platform system 14 may be of any suitable length such as for example about 8' long. This section can be larger or smaller if the operator decides. The platform system may have (2) 4' articulated platforms (folding wings) 56 that are attached to each end of the platform 18 at a pivot point 122. These articulated platforms 56 can adjust to hips and valleys 124 of the roof. They may be hinged 126 at any desired location to fold in a direction substantially orthogonal to the platform 56 surface. They may have a ½" bolt for hinge 128, as shown in FIG. 2, that allows the operator substantially 180-degree movement of the platform about pivot 122.

The main platform may have a suitable slot 130, for example about 9/16 in diameter, such that when the wing is fully extended, will allow it to be turned 90 degrees in either direction about pivot 122 and locked in position with bolt 128. The platforms 56 are equipped with wheels 132 enabling the articulate platforms to move as a unit with the main platform when the drive system 16 is operated to ascend/descend the platform system. The wheels 132 may have a Len-Soft brake 134 that is engaged at all times. This brake may be lifted up and hooked to the platform edge if the operator decides to reverse direction. If the structure is L-shaped, the articulated platforms will allow the operator to do hips or valleys without any loss of time.

Figure 12:
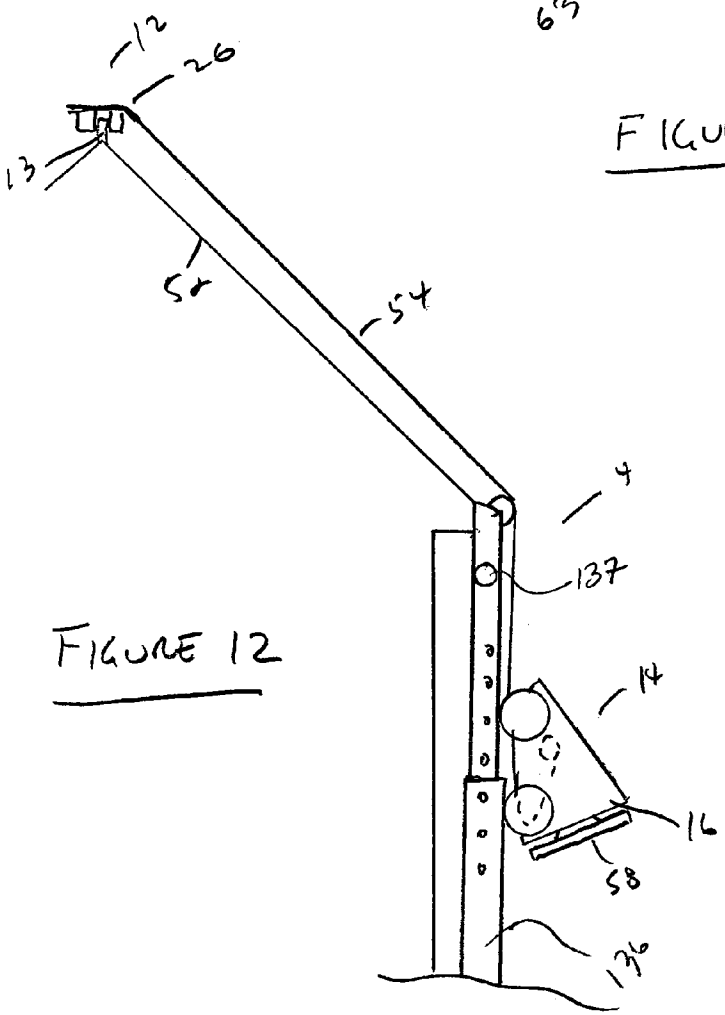
FIG. 12 is another side elevation view of the roofing apparatus in FIG. 1 showing the platform in a different position.

Referring also to FIG. 12, when arriving at the job site the operator can first attach rail 12 to the ridge or opposite side of the structure. The rail 12 may extend at a suitable stand off above the ridgeline or be otherwise mounted on the roof. The operator may then attach the support cables 54 to the rail and drop the cable end to the ground. At the ground, the operator may then hook the cable to the apparatus drive system 16 described previously. The apparatus support system 4 may have two (2) telescopic mounting poles 136 which have an adjustable desired length, 15 feet for example. These poles 136 may be 1⅜×⅞ for example, though any other suitable section may be used. The poles 136 can have ¼" walls for example, and can be made out of square tubing, such as from aluminum. These poles may have two 8'6" support rods 137, of ½" diameter for example, that may be used to connect the mounting poles 136 to each other. One rod 136 may be at ground level and the other rod 136 at the roof level. The drive system 16 will ride these mounting poles 136 to the roof edge as shown in FIG. 12.

Referring also to FIGS. 10 and 11, the operator can drop the lowering platform 58 from the drive system 16. The lowering platform 58 is supported by cables 170 (see also FIG. 1) and may have two drop bars 150, 152 that are for example 1⅜ square tubing, and two extension pieces 153 (for example ⅞ square tubing 7' long). These extension pieces 153 may fit into the ends 151 of the drop bar 150, 152 facing towards the ground. Also, as shown in FIG. 11, the ends of the lowering platform 58 has slots 154, 156 into which the extension pieces 153 are received to further improve the lowering platform's stability. In addition, rolling guides 182, 184 may be provided to further support the lowering platform when loaded and to roll upon the side of the structure so that lowering platform may move horizontally with the drive system. Bar 186 may couple rolling guides 182, 184 together to further stabilize the assembly. The operator may position himself by lowering the platform 58 so that he may shingle a portion of the roof, such as the first 4' of roof, located below the platform 18 of the apparatus. The platform may ride on the drop bar in slots 154, 156 to ensure an even descent. The operator may engage the horizontal motor if and when he is ready to move.

Figure 13:
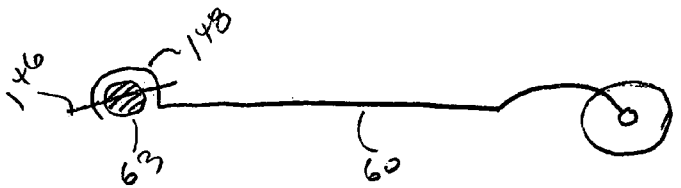
FIG. 13 is a side elevation view of a stabilizer of the roofing apparatus in FIG. 1.

Referring also to FIG. 13, the apparatus 10 can be fitted with three stabilizers 60 that extend 24" down from the lower wheel shaft 63. They may be fastened on by tapered pins 146, such as ⅜×2½" through hook end 148. The stabilizers may be used to assist while lifting materials from the ground level to the roof. When the pitch of the roof is changed, the stabilizers will change with it. These stabilizers may simply be removed by pulling the tapered pins 146.

As shown in FIG. 2, the apparatus 10 has handrail 166 (which may extend the length of the main platform 18) that is mounted on the back of the deck. It may be mounted in a desired number (for example 3) of spots so that it will not stick when operator chooses to use it. It may sit in (3) hollow tubes and these tubes may be suitably long and with suitable wall thickness to anchor the handrail. The handrail may have rods that will extend through tubing. They may be flanged once they are installed. This rail is meant to assist the operator when moving from the roof tractor platform to the lowering platform. Upon finishing the first four feet of roofing, the operator may return to the main platform 18 of the apparatus may store the lowering platform and it's accessories on the back of the platform system 14 as shown in FIG. 12.

Figure 4A:
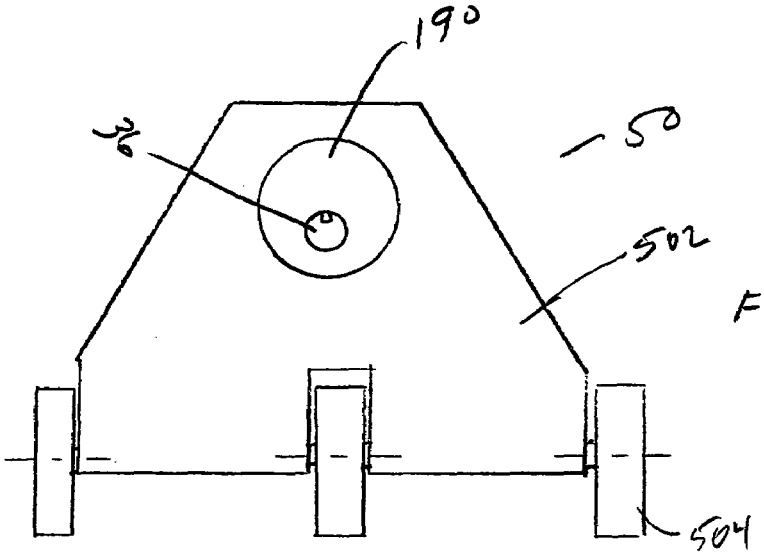
FIGS. 4A-4B respectively are a side elevation view, and a front elevation view of a horizontal drive of the roofing apparatus in FIG. 1.
Figure 4B:
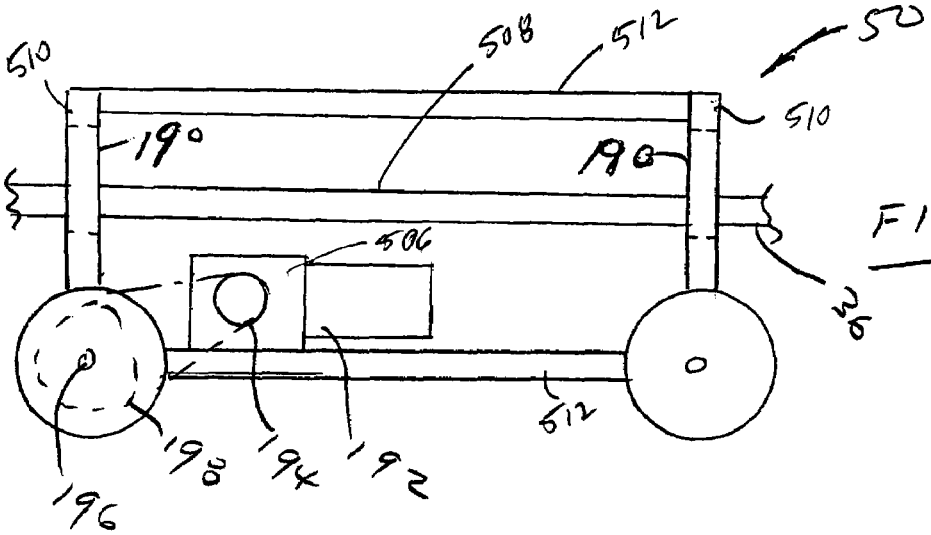
Figure 9:
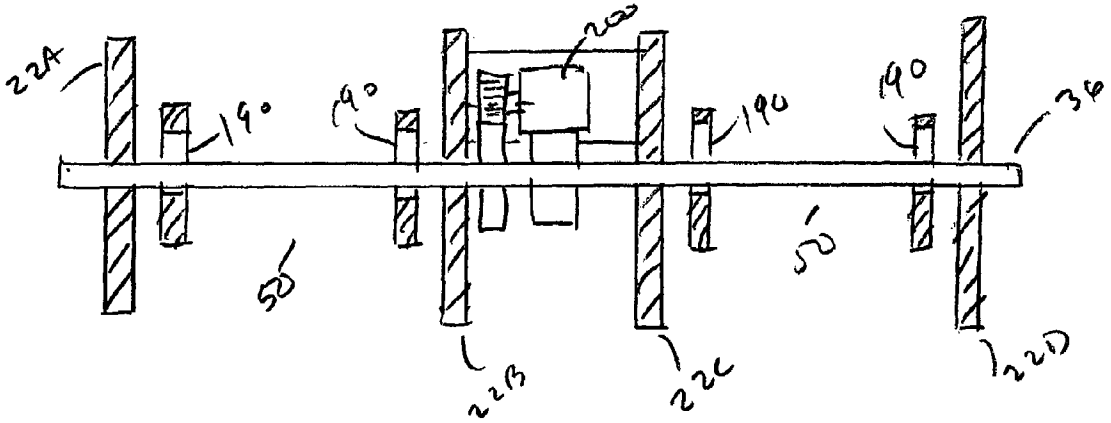
FIG. 9 is yet another top section view of the drive system of the roofing apparatus in FIG. 1.

FIGS. 4A and 4B respectively are a side elevation view, and a front elevation view of a horizontal drive units 50 of the drive system 16. FIG. 1 shows the apparatus 10 with two horizontal drive units 50, though in alternate embodiments the apparatus 10 may have any desired number of horizontal drive units. As seen in FIG. 1, the horizontal drive units 50 are coupled to the platform system 16 and effect movement of the apparatus on the pitched surfaced of the roof in the direction indicated by arrow 64. The horizontal units 50 may be similar to each other. Though in alternate embodiments different units may be used. As seen best in FIGS. 4A-4B, each horizontal unit comprises support structure 502, rollers 504 and drive system 506. The horizontal drive unit 50 also has an engagement system 508 that movably couples the drive unit 50 to the platform system 16 as will be described below. The support structure 502, shown for example purposes, may include support sections 510 and span members 512 interconnected in a general space frame or box structure of desired stiffness. Rollers 504, of which three may be located for example purposes at each end of the unit, may be rotatably mounted to the support structure (by suitable bearings or bushings) too allow the unit to roll substantially freely. The engagement system 508 includes a cam or eccentric 190 and shaft 36. The shaft 36 is eccentrically mounted in cam 190 as shown in FIG. 4A. The ends of shaft 36 extend and are connected to the support plates 22A-22C of the platform system 16 as shown in FIG. 9 (see also FIG. 3). The cams 190 are pivotably mounted into bores formed in the support sections 510 of the units 50. The cams 190 may be of any suitable size, such as for example about 6.0 inches. The eccentricity between shaft 36 and cam 190 may be, for example, about 2.0 inches, providing an overall travel between the drive unit 50 and platform system 16 of about 4.0 inches. In alternate embodiments, any suitable engagement system may be used between horizontal drive units and the platform system 16. Hence, the horizontal drive units 50 are movably mounted to the main platform 16 of the apparatus as described. The horizontal unit 50 may be raised or lowered by rotating the shaft 36 coupled to cam or eccentric 190. If desired, the shaft may be driven by gear motor 200 via suitable transmission. Otherwise, the shaft 36 may have suitable leverage for operation by manual means. This vertical travel of the horizontal drive units 50 may be useful when moving horizontal or when changing the roof tractor's pitch on the roof. Lowering the horizontal drive units 50 lifts wheels 24A, 24B (see FIG. 3) from the roof surface. Raising drive units 50 lowers the rollers 24A, 24B onto the roof surface and separates the drive units 50 from the roof surface.

The horizontal drive unit drive system 506 may have for example a ¼ HP, motor 192 mounted on a gear reduction box. The output shaft of motor 192 can have suitable drive sprocket 194 that will go to the rear drive axle 196 as shown in FIG. 4B, with an idler sprocket 198. The unit may move at 9⅓ rpm's. This unit is chain driven, though any suitable transmission system may be used.

The horizontal unit 50 may have several different uses. In addition to facilitating horizontal movement of the roof tractor, it may be lowered to its operating position anytime the operator brings materials up from the ground. This will increase stability when the operator decides to bring up several hundred pounds of material. After completion of roofing activity, or whenever otherwise desired, the operator may rotate the horizontal shaft to return the horizontal unit to a resting position separated from the roof surface.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A pitched roof roofing apparatus comprising;

a support rail;

a platform movably mounted to the support rail, the platform having wheels arranged to ride freely on and in direct contact with a pitched roof surface; and a drive system operably connecting the platform to the support rail, the drive system being adapted to move the platform on the pitched roof surface in at least two orthogonal directions relative to the support rail.

2. The pitched roof roofing apparatus according to claim 1 wherein the platform is adjustable to maintain the platform level relative to ground.

3. The pitched roof roofing apparatus according to claim 1 wherein the platform comprises at least one articulated section adapted to pivot relative to another portion of the platform and be supported by a hip or valley adjoining the pitched surface.

4. The pitched roof roofing apparatus according to claim 1 further comprising guide rails capable of being coupled to the pitched surface; wherein when the guide rails are coupled to the pitched surface, the drive system is guided by the guide rails to raise the platform to the pitched surface.

5. The pitched roof roofing apparatus according to claim 4, wherein the guide rails comprise telescoping poles.

6. The pitched roof roofing apparatus according to claim 1 further comprising a lowering platform operably connected to the drive system, the drive system being adapted to move the lowering platform relative to the platform.

7. The pitched roof roofing apparatus according to claim 6, wherein the lowering platform is movable between a stowed position and a deployed position, wherein in the deployed position the lowering platform is carried by the drive system and provides access for roofing a portion of the pitched surface below the platform.

8. The pitched roof roofing apparatus according to claim 6 further comprising a drop bar coupled to the drive system; wherein the lowering platform is guided by the drop bar when the lowering platform is moving relative to the platform.

9. The pitched roof roofing apparatus according to claim 1 further comprising a handrail coupled to the platform.

10. The pitched roof roofing apparatus according to claim 1 further comprising a stabilizer coupled to the drive system, the stabilizer having a roller for contacting the pitched surface and stabilizing the platform.

11. A pitched roof roofing apparatus comprising;

a support rail;

a platform movably coupled to the support rail;

a drive system operably connecting the platform to the support rail by at least two cables; and a lowering platform coupled to the drive system; the drive system being adapted to move the platform on a pitched surface in at least two orthogonal directions relative to the support rail; the drive system being further adapted to move the lowering platform relative to the platform.

12. The pitched roof roofing apparatus according to claim 11 wherein the drive system comprises a motor coupled to at least two pulleys, the at least two pulleys coupled to the cables.

13. The pitched roof roofing apparatus according to claim 12 wherein the drive system further comprises a spring loaded locking mechanism, the spring loaded locking mechanism preventing the at least two pulleys from rotation.

14. The pitched roof roofing apparatus according to claim 13 wherein the spring loaded locking mechanism has at least two dogs engaging two separate wheels, wherein the wheels are coupled to the at least two pulleys.

15. The pitched roof roofing apparatus according to claim 11 wherein the drive system comprises a horizontal drive unit coupled to the platform with an eccentric, wherein the horizontal drive unit engages the pitched surface upon rotation of the eccentric in a first direction.

16. The pitched roof roofing apparatus according to claim 15 wherein the drive system further comprises a vertical drive unit coupled to the platform, wherein the vertical drive unit disengages the pitched surface upon rotation of the eccentric in the first direction.

17. A pitched roof roofing apparatus comprising;

a support rail;

a platform movably mounted to the support rail, the platform having wheels arranged to ride freely on and in direct contact with a pitched roof surface; and a drive system operably connecting the platform to the support rail, the drive system having a horizontal drive unit being adapted to move the platform on the pitched surface in a first direction, the drive system having a vertical drive unit being adapted to move the platform on the pitched surface in a second direction orthogonal relative to the first direction, wherein the platform is adjustable relative to the drive system to maintain the platform level relative to ground.

18. The pitched roof roofing apparatus according to claim 17 wherein the horizontal drive unit is coupled to the vertical drive unit with a shaft, and wherein the horizontal drive unit selectively engages the pitched surface upon rotation of the shaft in one direction.

19. The pitched roof roofing apparatus according to claim 18 wherein the vertical drive unit disengages the pitched surface after the horizontal drive unit engages the pitched surface upon further rotation of the shaft in the one direction.

20. The pitched roof roofing apparatus according to claim 17 further comprising at least one other platform pivotally coupled to the platform; wherein the other platform is adapted to pivot relative to the platform in at least two orthogonal directions and be supported by a hip or valley adjoining the pitched surface.

21. The pitched roof roofing apparatus according to claim 20 wherein the other platform further comprises a support wheel having a brake, the support wheel supporting the other platform on the hip or valley adjoining the pitched surface.

* * * * *